US007857014B2

(12) United States Patent
Gamberini

(10) Patent No.: US 7,857,014 B2
(45) Date of Patent: Dec. 28, 2010

(54) MACHINE FOR METERING MICROTABLETS

(75) Inventor: Ernesto Gamberini, Rastignano (IT)

(73) Assignee: MG 2 S.r.l., Pianoro (IT)

( * ) Notice: Subject to any disclaimer, the term of this patent is extended or adjusted under 35 U.S.C. 154(b) by 1042 days.

(21) Appl. No.: 11/613,611

(22) Filed: Dec. 20, 2006

(65) Prior Publication Data

US 2007/0144674 A1 Jun. 28, 2007

(30) Foreign Application Priority Data

Dec. 23, 2005 (IT) ..... B02005A0791

(51) Int. Cl.
*B65B 37/00* (2006.01)

(52) U.S. Cl. ..... 141/239; 141/34; 141/147; 53/253

(58) Field of Classification Search ..... 141/34, 141/108, 129, 135, 144, 147, 156, 192, 237, 141/238, 239, 242; 53/247, 250, 253, 473, 53/560, 900

See application file for complete search history.

(56) References Cited

U.S. PATENT DOCUMENTS 3,986,534 A * 10/1976 Schmidt ..... 141/1
4,070,248 A * 1/1978 Schmidt ..... 435/33
6,814,111 B1 * 11/2004 Oliverio et al. ..... 141/237
6,901,972 B1 * 6/2005 Nelson ..... 141/67

* cited by examiner

*Primary Examiner*—Gregory L Huson
*Assistant Examiner*—Jason K Niesz
(74) *Attorney, Agent, or Firm*—Gottlieb, Rackman & Reisman P.C.

(57) ABSTRACT

A machine for metering microtablets into capsules has a metering surface subjected to vibration and to rotation about a respective perpendicular axis; and an unloading device, which is fixed with respect to and cooperates with the metering surface, and is substantially defined by a cam member and an air outlet. In the metering surface are formed a number of sloping surfaces, along which the microtablets travel upwards, and a respective number of pockets, each for receiving the microtablets from a respective sloping surface. Each pocket has a bottom wall, which cooperates with the cam member and is movable between a fully-closed position, in which the microtablets are retained inside the respective pocket, and a fully-open position, in which the microtablets are unloaded. A number of holes are formed in a raised edge of the metering surface, and, when the holes are aligned with the air outlet, air is blown through the holes to prevent further microtablets from falling into the pockets.

5 Claims, 5 Drawing Sheets

MACHINE FOR METERING MICROTABLETS

The present invention relates to a machine for metering microtablets.

BACKGROUND OF THE INVENTION

In recent times, pharmaceuticals are produced for consumption by patients in the form of capsules containing a given volume of microtablets comprising the active principle. It is obviously essential, therefore, when filling the capsules, that each be filled with exactly the desired volume of microtablets.

The microtablets are normally minute cylinders roughly 2 mm in diameter and 2 mm high.

The inaccuracy with which the microtablets are deposited inside the capsules is mainly caused by the generation of electrostatic forces, which cause the microtablets to form into clusters, a phenomenon which seriously impairs automatic filling of the capsules and, hence, output.

SUMMARY OF THE INVENTION

It is an object of the present invention to provide a capsule-filling machine designed to eliminate the drawbacks of the known art.

According to the present invention, there is provided a machine for metering microtablets into capsules; said machine being characterized by comprising a metering surface subjected to vibration and to rotation about a respective perpendicular axis; there being formed in said metering surface a number of sloping surfaces, along which said microtablets travel upwards, and a respective number of pockets, each for receiving the microtablets from a respective sloping surface; each of said pockets comprising a bottom wall movable between a fully-closed position, in which the microtablets are retained inside the respective pocket, and a fully-open position, in which the microtablets are unloaded.

In a preferred embodiment, the metering machine according to the present invention comprises blow-off means for cutting off flow of the microtablets into a pocket.

In another preferred embodiment, the metering machine according to the present invention comprises a cam member for controlling the movement of said bottom walls of said pockets.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
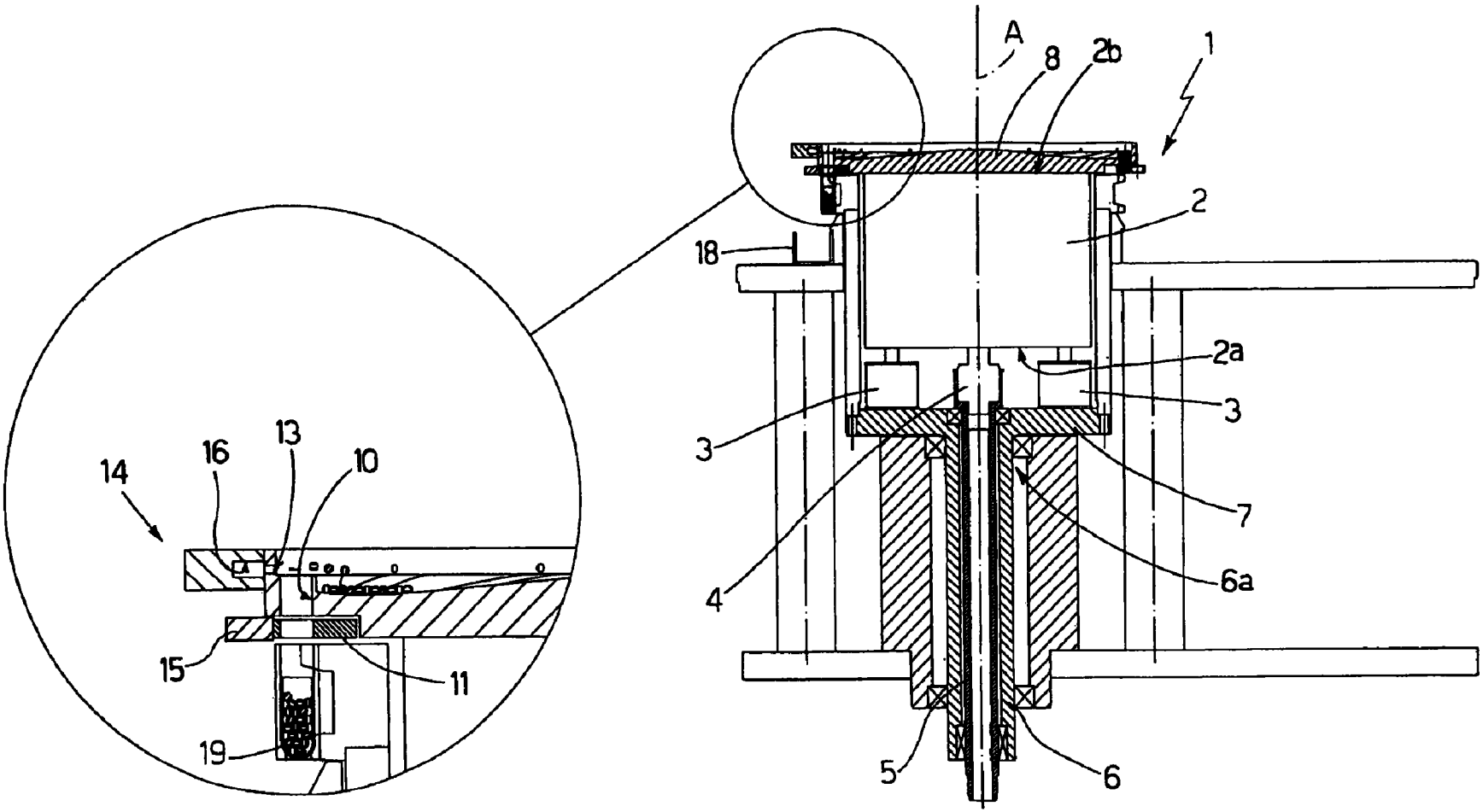
FIG. 1 shows a lateral section of a preferred embodiment of the machine according to the present invention.

Number 1 in FIG. 1 indicates as a whole the machine for metering microtablets into capsules according to the present invention.

Machine 1 comprises a cylindrical vibrating base 2, and a number of vibrators 3 (only two shown in FIG. 1) which act on a bottom surface 2*a* of vibrating base 2. Vibrating base 2 is fixed to a rotary connector 4 coaxial with vibrating base 2 along an axis A, and which in turn rests in rotary manner inside one end of a fixed hollow shaft 5 ensuring electric power supply to vibrators 3. Machine 1 comprises a rotating shaft 6 housing fixed shaft 5, and from the end 6*a* of which a plate 7 extends perpendicularly, is formed in one piece with rotating shaft 6, and is fitted with vibrators 3 to ensure rotation of vibrating base 2 about axis A.

In other words, vibrating base 2 is vibrated by vibrators 3, and is rotated about its axis of symmetry A by rotating shaft 6.

Machine 1 also comprises a circular metering surface 8, which is fixed to a top surface 2*b* of vibrating base 2, so as to be subjected to the same rotation and vibration as vibrating base 2.

Figure 2:
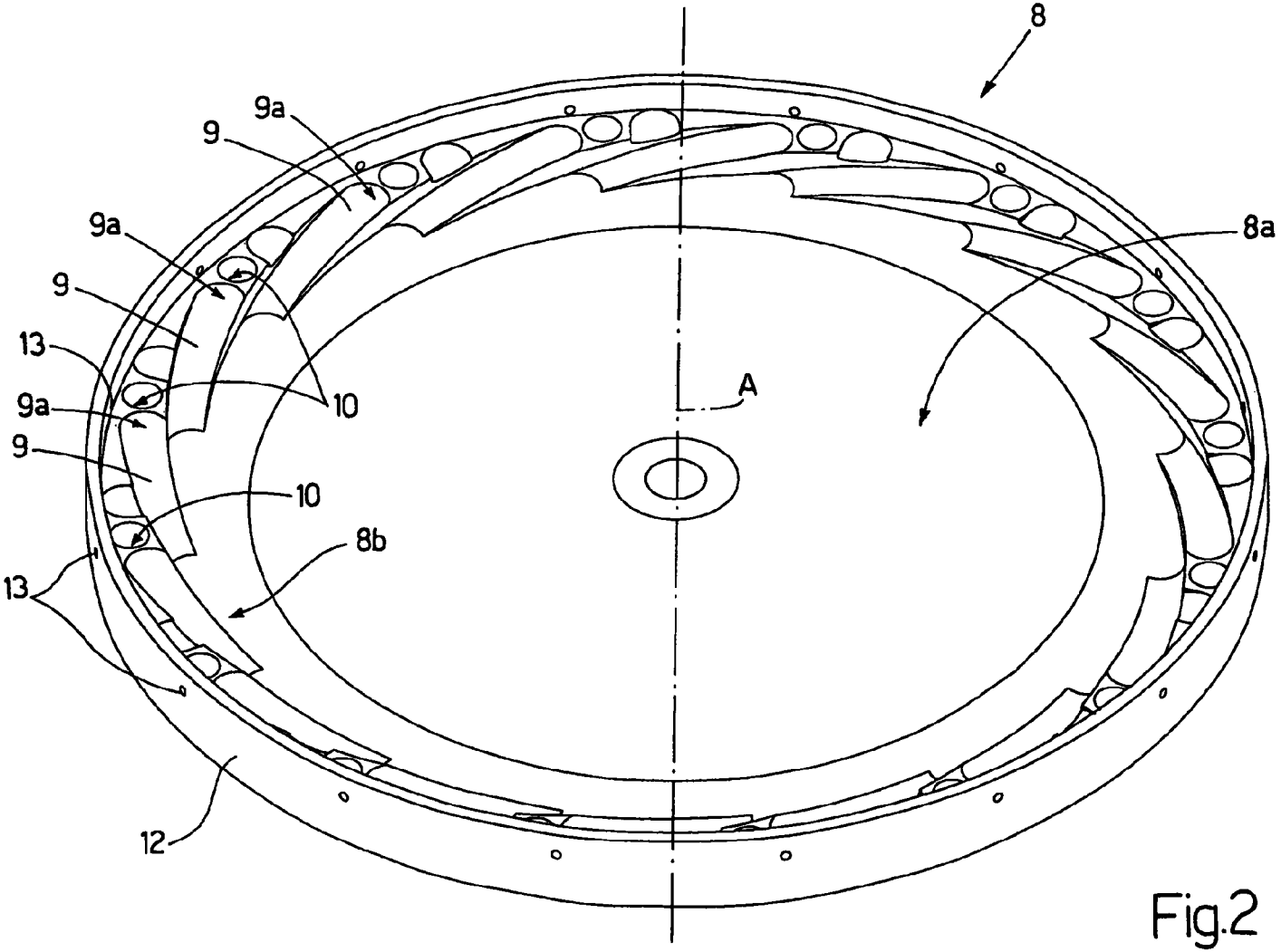
FIG. 2 shows a topside view in perspective of the metering surface of the FIG. 1 machine.

As shown in FIG. 2, a number of sloping surfaces 9, arranged consecutively in a circle, are formed on a peripheral portion 8*b* of a top surface 8*a* of metering surface 8. A number of pockets 10 are also formed on peripheral portion 8*b*, each located at a top end 9*a* of a respective sloping surface 9.

A microtablet deposited on top surface 8*a* of metering surface 8 is therefore forced upwards along a sloping surface 9 by vibration of metering surface 8, and, on reaching the end of sloping surface 9, crosses over top end 9*a* and drops into respective pocket 10.

Each pocket 10 comprises a bottom wall 11 movable between a fully-closed position, in which the microtablets are retained inside pocket 10, and a fully-open position, in which the microtablets inside pocket 10 are unloaded into a bottom shell of a capsule, as described below. Each bottom wall 11 is maintained, at rest, in the fully-closed position by a known torsion spring (not shown).

A number of holes 13 are formed in a raised edge 12 of peripheral portion 8*b*, and are each located at the top end 9*a* of a respective sloping surface 9. As described below, air is blown consecutively through holes 13 to cut off flow of the microtablets across end 9*a*.

Machine 1 comprises a microtablet unloading device 14 fixed with respect to and cooperating with metering surface 8 to unload the microtablets. In other words, being stationary as metering surface 8 rotates, unloading device 14 interacts consecutively with all the pockets 10 on metering surface 8.

Unloading device 14 comprises a cam member 15, which cooperates with bottom walls 11 of pockets 10 to open the bottom walls and so unload the microtablets; an air outlet 16, which blows air consecutively through holes 13 to prevent more than the predetermined number of microtablets from being deposited inside the pockets; a supporting plate 17 (shown in FIGS. 3-5) located beneath cam member 15 to support the microtablets dropping out of the open pocket, and which, being slanted, slides the microtablets down to its unloading end 17*a*, from where they drop into the bottom shell of the capsule being filled; and, finally, a catch bin 18 for the microtablets sliding off supporting plate 17 with no receiving bottom shell underneath.

Figure 3:
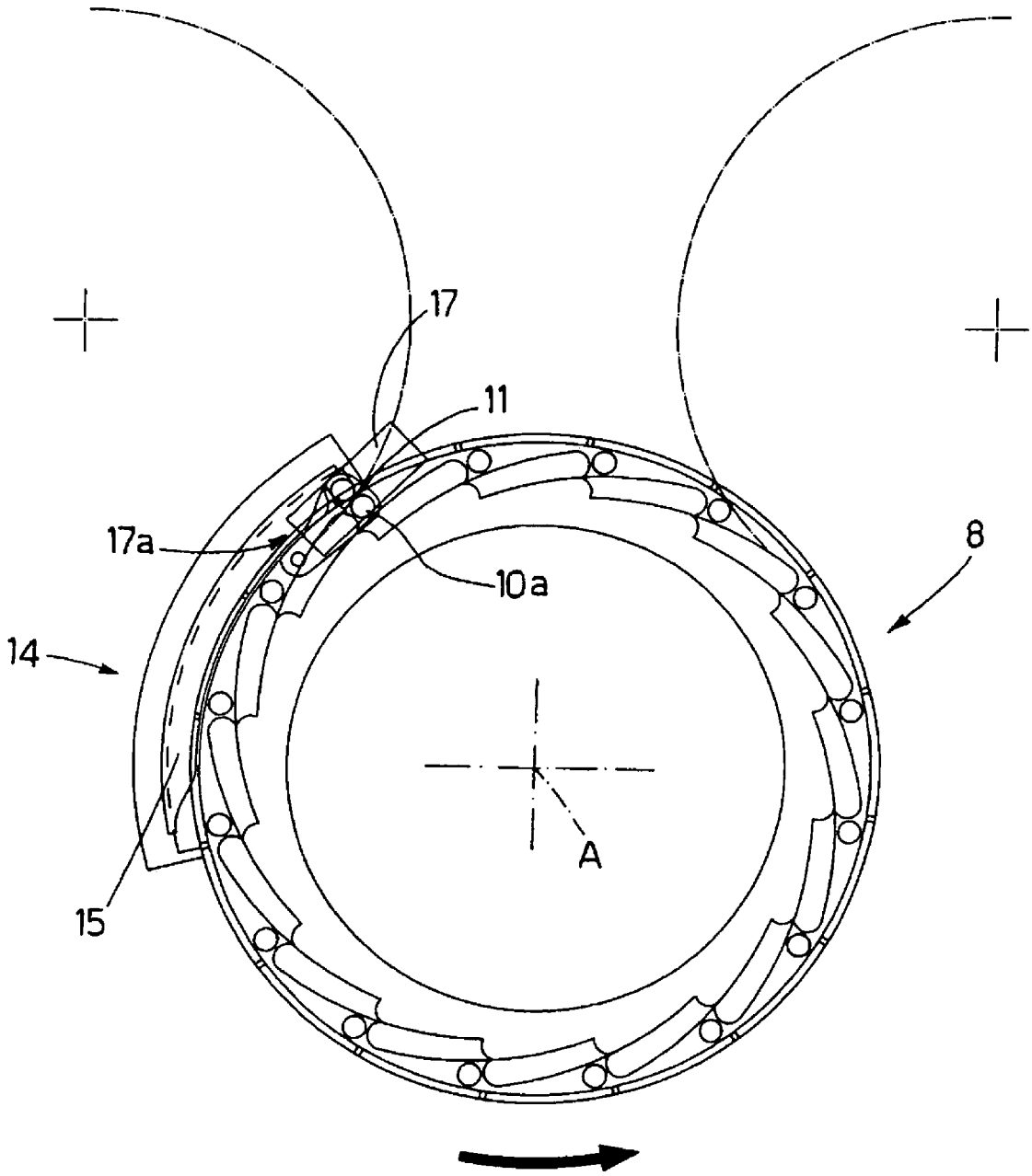
FIG. 3 shows a topside view of one operating stage of the FIG. 1 machine.
Figure 4:
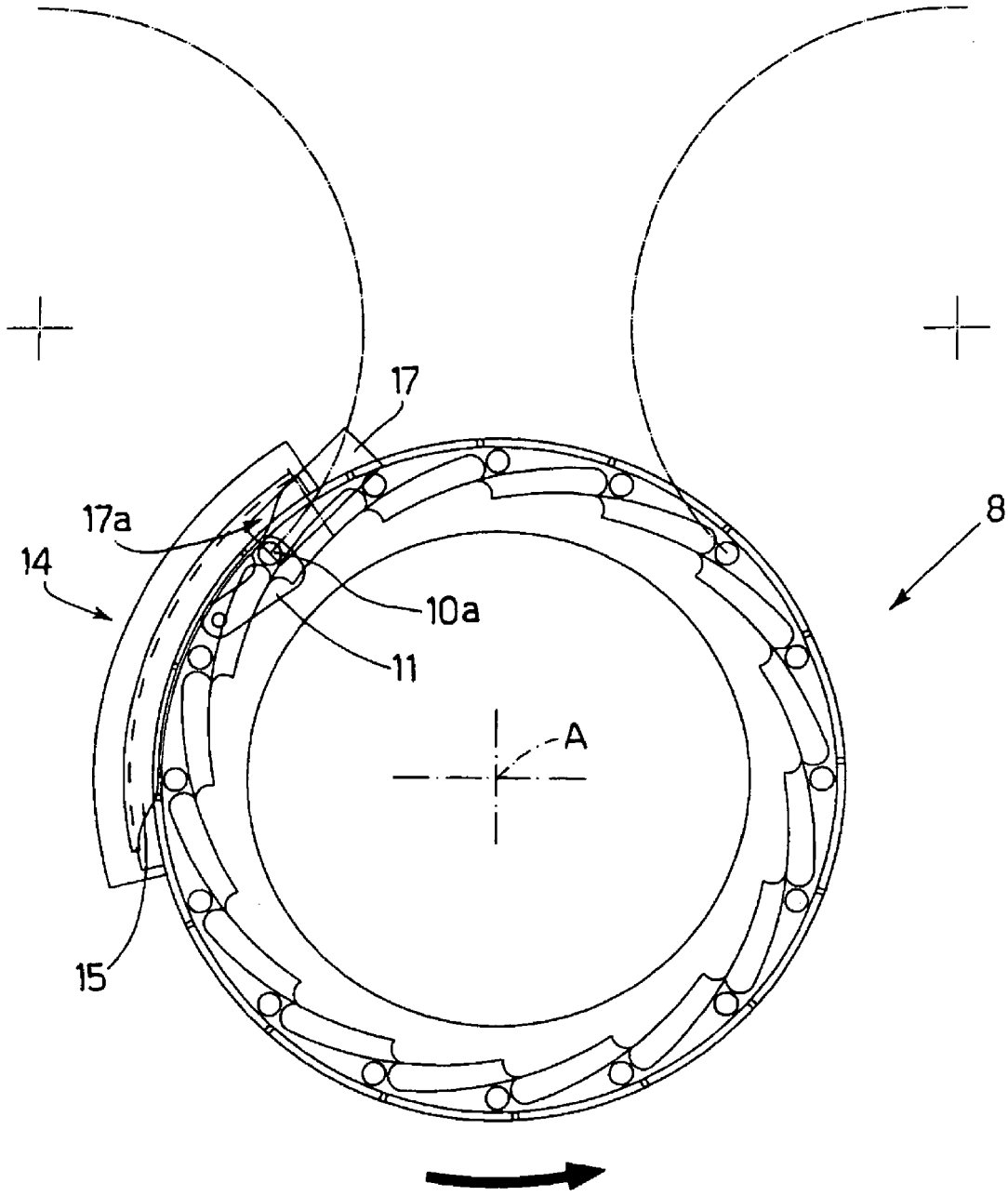
FIG. 4 shows a topside view of a further operating stage of the FIG. 1 machine.
Figure 5:
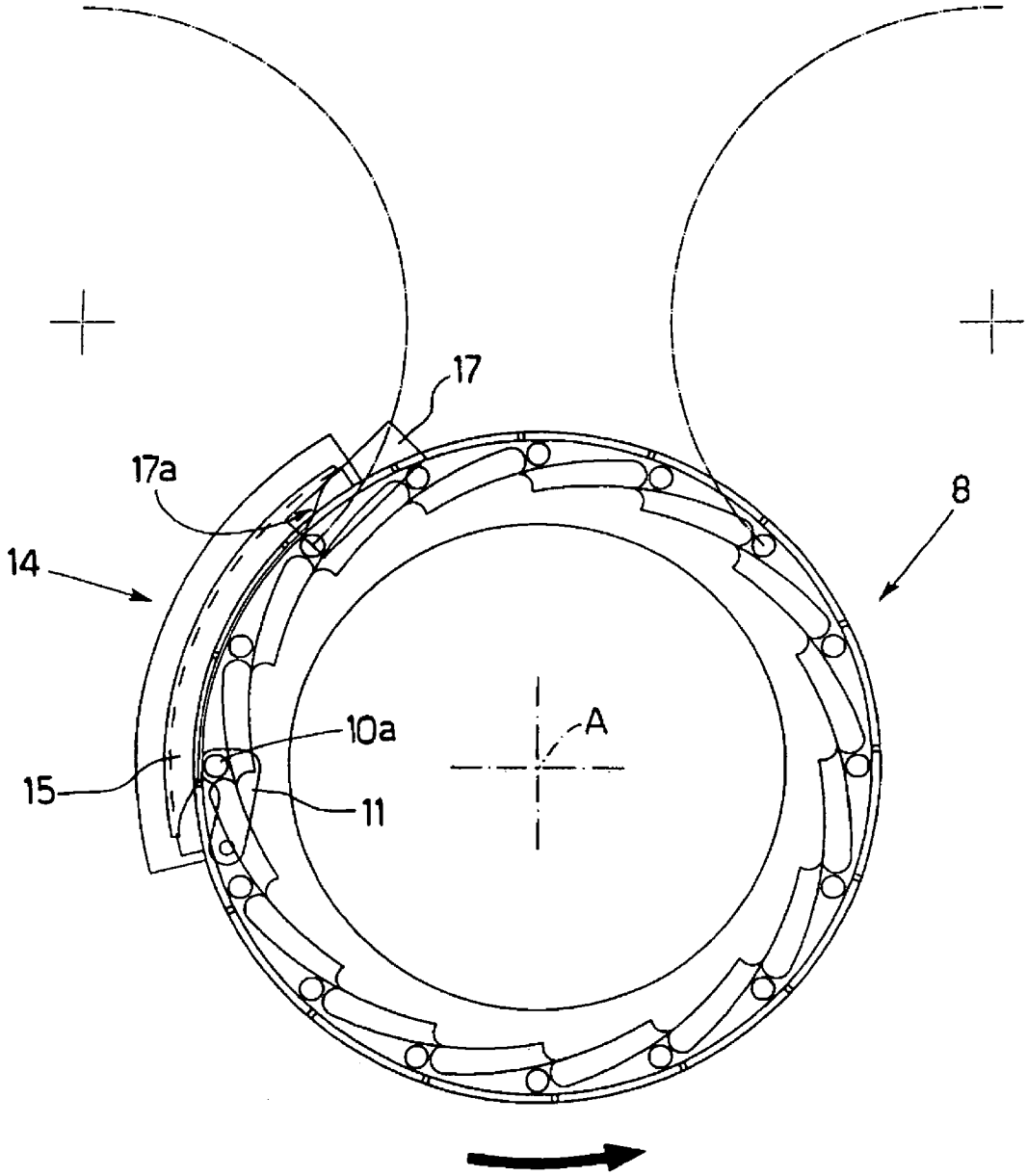
FIG. 5 shows a topside view of a further operating stage of the FIG. 1 machine.

In actual use, the microtablets are deposited on metering surface 8 rotating about respective axis A, and are forced, by vibration of metering surface 8, towards peripheral portion 8*b* and up along the various sloping surfaces 9, where they drop into respective pockets 10. Machine 1 is so timed that, by the time a specific pocket 10*a* contains the desired volume of microtablets, the pocket 10*a* is located at unloading device 14, as shown in FIG. 3. At this point, air outlet 16 blows air through respective hole 13, and the air issuing from the hole prevents any more microtablets from being deposited inside pocket 10*a*. Moreover, as the metering surface continues rotating, cam member 15 interacts with bottom wall 11 to move it into the fully-open position as shown in FIG. 4. As bottom wall 11 moves into the fully-open position, the microtablets fall by gravity onto supporting plate 17 and from there into the bottom shell 19 carried by known conveying means (not described for the sake of simplicity) and located at the unloading end 17*a* of supporting plate 17. Once all the microtablets are unloaded from pocket 10*a*, the machine is in the condition shown in FIG. 5, in which bottom wall 11 is about to be restored to the closed position, and airflow through hole 13 will be cut off as soon as pocket 10*a* leaves unloading device 14. Metering surface 8 continues rotating, and, after a roughly ¾ turn, pocket 10*a* once more approaches unloading device 14, as shown in FIG. 3, and the operations described above are repeated.

The machine according to the present invention clearly has the advantage of metering the microtablets accurately into the capsules, and so preventing other than the predetermined volume of microtablets from being deposited in each capsule. More specifically, the vibratory movement and the compulsory upward travel of the microtablets prevent clustering phenomena caused by electrostatic forces generated between the microtablets.

Moreover, the blow-off means further ensure the exact volume of microtablets inside the capsules.

One variation of the machine as described above comprises a sensor for each sloping surface. The sensor counts the number of microtablets deposited inside the respective pocket and activates the blow-off means, which, in this case, are fixed to the metering surface as opposed to forming part of the unloading device.

The invention claimed is:

1. A machine (1) for metering microtablets into capsules; said machine being characterized by comprising a metering surface (8) subjected to vibration and to rotation about a respective perpendicular axis (A); there being formed in said metering surface (8) a number of sloping surfaces (9), along which said microtablets travel upwards, and a respective number of pockets (10), each for receiving the microtablets from a respective sloping surface (9); each of said pockets (10) comprising a bottom wall (11) movable between a fully-closed position, in which the microtablets are retained inside the respective pocket (10), and a fully-open position, in which the microtablets are unloaded.

2. A machine for metering microtablets as claimed in claim 1, characterized by comprising blow-off means (13, 16) for cutting off flow of the microtablets into a pocket (10).

3. A machine for metering microtablets as claimed in claim 2, characterized in that said metering surface comprises a raised peripheral edge (12) and wherein said blow-off means comprises a number of holes formed in said raised peripheral edge (13), each hole located at a top end (9*a*) of a respective sloping surface (9).

4. A machine for metering microtablets as claimed in claim 3, characterized by comprising a cam member (15) for controlling the movement of said bottom walls (11) of said pockets (10).

5. A machine for metering microtablets as claimed in claim 4, characterized by comprising a microtablet unloading device (14) fixed with respect to said metering surface (8), and which in turn comprises said cam member (15), and wherein said blow-off means further comprises an air outlet (16) for blowing air consecutively through said holes (13).

* * * * *